US007252133B2

(12) United States Patent
Bengtsson et al.

(10) Patent No.: US 7,252,133 B2
(45) Date of Patent: Aug. 7, 2007

(54) HIGH LOAD OPERATION OF AN INDUSTRIAL ROLL DOOR

(75) Inventors: Mikael Bengtsson, Eldsberga (SE); Hakan Larsson, Halmstad (SE); Raymond Sauve, Stone Mountain, GA (US); Holger Siewert, Rheda-Wiedenbrueck (DE); Jan Victor, Halmstad (SE); Kent Palsson, Aled (SE)

(73) Assignee: Albany International Corp., Albany, NY (US)

( * ) Notice: Subject to any disclaimer, the term of this patent is extended or adjusted under 35 U.S.C. 154(b) by 283 days.

(21) Appl. No.: 10/838,783

(22) Filed: May 4, 2004

(65) Prior Publication Data

US 2005/0247412 A1 Nov. 10, 2005

(51) Int. Cl.
*A47H 1/00* (2006.01)
*E06B 3/94* (2006.01)

(52) U.S. Cl. ..... 160/265; 160/265; 160/133

(58) Field of Classification Search ..... 160/265, 160/191, 192, 322, 133, 264, 290.1
See application file for complete search history.

(56) References Cited

U.S. PATENT DOCUMENTS

| | | | | |
|---|---|---|---|---|
| 520,089 | A | 5/1894 | Spaulding | |
| 3,039,318 | A | 6/1962 | Clarke | |
| 3,878,879 | A | 4/1975 | Manns | 160/273 |
| 4,252,172 | A | 2/1981 | Pommat et al. | 160/322 |
| 4,760,622 | A | 8/1988 | Rohrman | 16/196 |
| 4,887,660 | A * | 12/1989 | Kraus | 160/265 |
| 4,997,022 | A | 3/1991 | Klein | 160/265 |
| 5,048,588 | A * | 9/1991 | Weishar et al. | 160/265 |
| 5,078,197 | A * | 1/1992 | Weishar | 160/265 |
| 5,129,442 | A * | 7/1992 | Warner | 160/271 |
| 5,141,044 | A | 8/1992 | Hying et al. | |
| 5,159,967 | A | 11/1992 | Ashley et al. | |
| 5,201,897 | A | 4/1993 | Whiting | 267/155 |
| 5,222,541 | A * | 6/1993 | Hornberger | 160/265 |
| 5,299,617 | A | 4/1994 | Hying et al. | |
| 5,368,084 | A | 11/1994 | Hying et al. | |
| 5,474,117 | A * | 12/1995 | Henkenjohann | 160/133 |
| 5,530,991 | A | 7/1996 | deNormand et al. | |
| 5,632,317 | A * | 5/1997 | Krupke et al. | 160/265 |
| 5,930,865 | A | 8/1999 | Mihalcheon | 16/197 |
| 6,019,156 | A * | 2/2000 | Wagner et al. | 160/310 |
| 6,122,862 | A * | 9/2000 | Hormann | 49/197 |
| 6,439,292 | B1 * | 8/2002 | Schutte et al. | 160/265 |
| 6,467,128 | B1 | 10/2002 | Damani | |
| 6,735,820 | B1 * | 5/2004 | Teutsch | 16/72 |

* cited by examiner

*Primary Examiner*—Hugh B. Thompson, II
*Assistant Examiner*—Candace L. Bradford
(74) *Attorney, Agent, or Firm*—Frommer Lawrence & Haug LLP; Ronald R. Santucci

(57) ABSTRACT

A high load operation industrial roll door, including a flexible door curtain windable about a top roll positioned above a door opening and provided with a drive system. The roll door includes a bottom beam fastened to the door curtain, and a biasing spring, for resisting movement of the door upon application of a load thereon, and a positive stop preventing movement of the biasing means beyond a predetermined point.

59 Claims, 7 Drawing Sheets

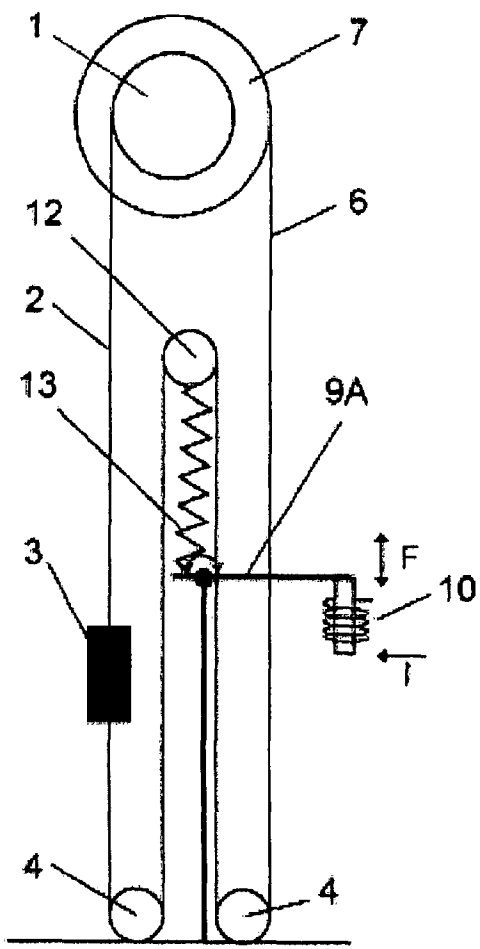
FIG. 18
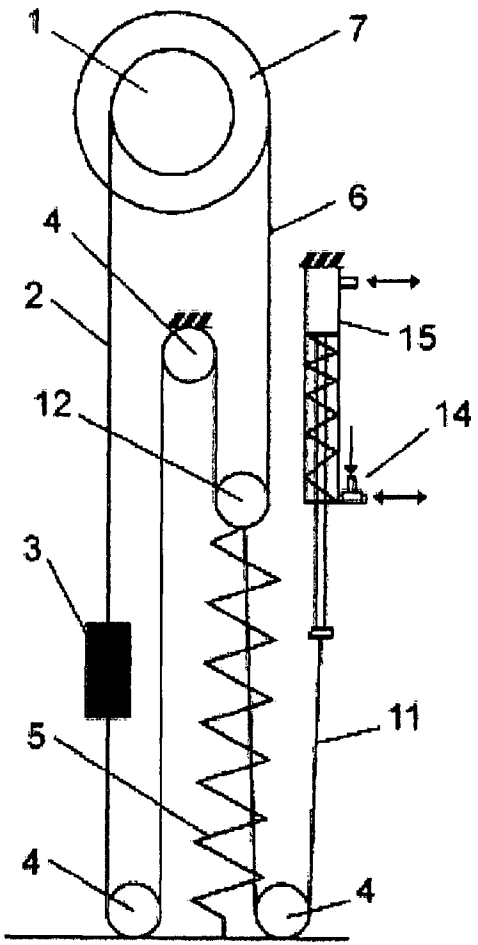
FIG. 19
FIG. 20

HIGH LOAD OPERATION OF AN INDUSTRIAL ROLL DOOR

FIELD OF THE INVENTION

The present invention relates to the high load operation of an industrial roll door. More specifically, the invention relates to a roll door comprising a door blade, or curtain, which is windable about a roll that is provided with a drive system, a biasing means, and means for preventing the biasing means from traveling beyond a predetermined point, so to prevent movement of the curtain when an external load is applied.

BACKGROUND OF THE INVENTION

Since the 1970's there has been a great need to use rapidly moving doors in buildings for industrial use. This applies to openings indoors as well as in external walls, where the door provides shielding between different activities or prevents drafts and heat losses. Presently, rolling doors with flexible door leaves are used for this purpose, but also more rigid constructions like slatted doors with polymeric or metallic lamellae are used. These doors are rolled up on an overhead drive cylinder and can be provided with additional elements like transverse wind reinforcements on the door leaf to counteract wind load, a weight balance system, tensioning system, windows or the like. For safety reasons, rolling doors can be further provided with safety edge protection, failsafe devices, drop protection, and crash safety functions.

U.S. Pat. No. 5,222,541 teaches a roll-up industrial door with a counter-balancing and tensioning system which counter-balances the weight of the door panel and, through a biasing mechanism, applies a downward tension to the closed door panel to stretch the panel and resist wind deflection. It is noted that the system operates with constant force in the pull-down direction, but contains no locking of the door leaf in the lower position. In any case, the invention is primarily directed to a break-away function.

U.S. Pat. No. 5,474,117 describes a locking mechanism for a roll-up closure with horizontal slats. The lowermost and uppermost slats carry spring-biased pins which resist unintentional lifting of the closure. The drawings of this patent shows a door locked at the bottom. It is noted that similar solutions have been previously proposed, but mainly as catching devices.

A related door construction is disclosed in U.S. Pat. No. 5,632,317. The invention is a roll-up door assembly with a number of embodiments including a moveable barrier bar to minimize deflection of the door closure member, or curtain, due to wind or other pressure generating forces. However, this solution is very complex and contains expensive elements. In addition, manual locking of the door is also provided for added wind resistance.

U.S. Pat. No. 6,439,292 is a roll-up door with a crash safety system that can automatically return the door to an operational condition. In the event that the door is not automatically restored to operation, it can be restored manually. It is noted that this patent presents a break-away function in combination with a photocell for safe operation during opening and closing of the door.

While some of the foregoing references have certain attendant advantages, further improvements and/or alternative forms, are always desirable.

SUMMARY OF THE INVENTION

It is an object of the present invention to provide an industrial door that reduces the potential for trespassing and unwanted draft by substantially reducing the buldging of the industrial door in the vertical direction.

It is another object of the present invention to provide an industrial door that safely restricts the door blade edges to guide channels, and thereby prevents unwanted trespassing by substantially reducing the buldging of the industrial door in the horizontal direction.

It is another object of the present invention to provide an industrial door that safely can withstand unwanted inwards or outwards buldging of the door blade in machine protection door installations. The inwards buidging may be caused by people falling into the door. The outwards buldging may be caused by e.g., robot arms or by goods that are thrown around by a runaway robot.

The present invention provides a high load operation industrial roll door. One embodiment of the present invention described herein provides a positive stop inserted into a tensioning/counter-balance mechanism of the door. This positive stop prevents a counterbalance spring or other biasing means from moving beyond a certain point, thereby keeping the door blade in a closed position when subjected to high winds or other external forces that cause heavy loading on the door.

These embodiments typically comprises a door curtain which is windable about a roll that is provided with a drive system, a biasing means operable to stretch when a load is applied to the curtain, a cable having a first end connected to the bottom of the curtain, the cable running therefrom over pulleys, a second end of the cable being connected to a cable drum, and a positive stop preventing the biasing means from traveling beyond a predetermined point, so to prevent movement of the closed curtain when an external load is applied thereto.

Another embodiment of the present invention includes an extra pulley and a divided cable. This embodiment also includes a roll and cable drum provided with a drive system; a door curtain to be wound upon the roll and unwound from the roll; a biasing means operable to travel/stretch when a load is applied to the curtain; a first cable to be wound/unwound from the cable drum and having one end connected thereto, the first cable running therefrom over first and second pulleys and the other cable end being connected to a reduction pulley; and a second cable with one end being fixed, the second cable running therefrom over the reduction pulley and a third pulley, and the other cable end being connected to the bottom of the curtain.

BRIEF DESCRIPTION OF THE DRAWINGS

For a more complete understanding of the invention, reference is made to the following description and accompanying drawings, in which:

FIG. 18 is a side view of a door system with a pulley and a mechanical spring positive stop according to the present invention;

FIG. 19 is a side view of a door system with a pulley and a pneumatic piston positive stop according to the present invention; and FIG. 20 is a side view of a door system with a pulley and an electro-mechanical pressure spring stop according to the present invention.

DETAILED DESCRIPTION OF THE PREFERRED EMBODIMENTS

Figure 1:
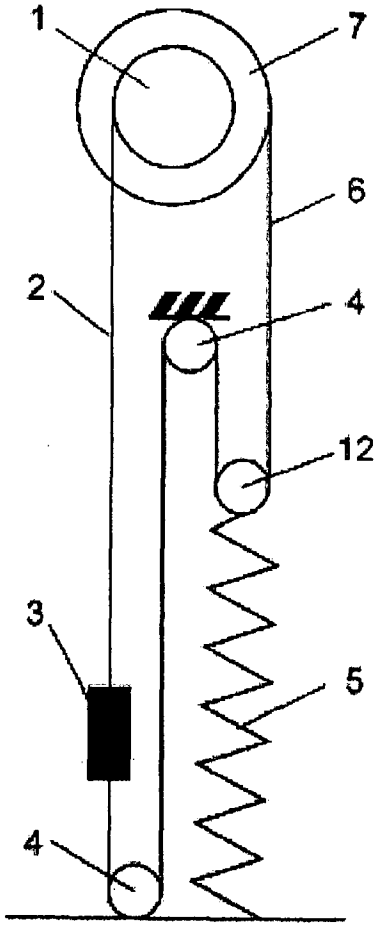
FIG. 1 (PRIOR ART)
FIG. 1 shows a side elevation view of a prior art door system.
Figure 3:
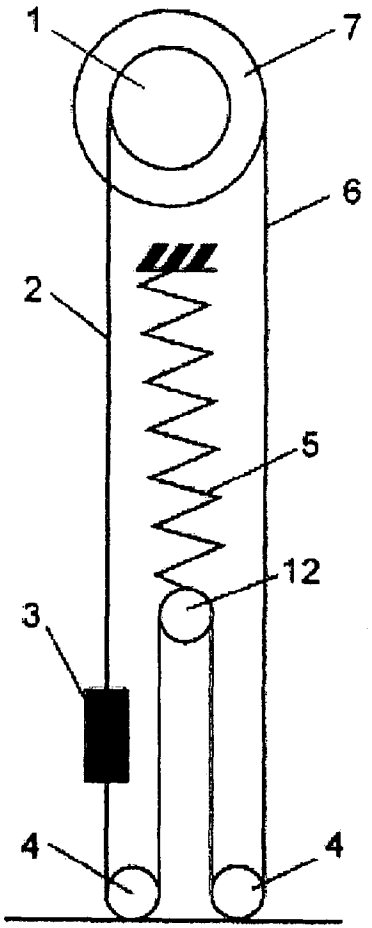
FIG. 3 (PRIOR ART)
FIG. 3 is a side view of a prior art door system with an alternative spring position.

FIGS. 1 and 3 show side views of prior art roll doors with standard tensioning and balancing systems. As can be seen in FIG. 1, a top roll 1 and cable drum 7 are rotatably mounted above the door and provided with a drive system (not shown), with a door curtain (door blade) 2, operable to be wound and unwound about the top roll 1. In addition, a bottom beam 3 is fastened to the bottom end of the door curtain 2. A cable 6 is provided and has one end attached to the bottom beam 3, with the other end attached to the cable drum 7. The cable 6 runs around stationary pulley 4 and over a movable pulley 12 loaded by a biasing tension resistant spring 5. The tension resistant spring 5 can be alternatively positioned at the top of the doorway as shown in FIG. 3. In either case, the spring 5 stretches when the curtain 2 is loaded, for example, by wind or other external forces. However, with the standard door systems shown in FIGS. 1 and 3, the stretching/elongation of the spring tension resistant 5 is unrestricted (except for the internal force of the spring). Unfortunately, this may lead to the unwanted raising of the bottom beam 3 in high wind conditions or when other external forces act on the door curtain 2.

Advantageously, the door tensioning and balance system according to the present invention provides a solution to the above-described problems while avoiding the drawbacks of the prior art door systems. It is appreciated that the cable 6 could be in the form of a wire, a belt, a chain, a cord, a rope, or other configurations without departing from the scope of the present invention. Further alternatives to the top roll 1 may be employed including but not limited to disks located on each side of the door, truss rolls of a desired size or other means known to those of skill in the art.

As shown in FIG. 3, one embodiment of the invention includes a door curtain 2 windable about a top roll 1 that is positioned above the door opening and provided with a drive system (not shown). A bottom beam 3 is fastened to the end of the curtain 2. A cable 6 is further provided and has one end attached to the bottom beam 3, with the other end attached to the cable drum 7. The cable 6 runs around stationary pulleys 4 and over a movable pulley 12 loaded by a biasing tension resistant spring 5. The tension resistant spring 5 stretches when the curtain 2 is loaded.

Whereas spring elongation is unrestricted in a standard tensioning system, the present invention, as shown in FIG. 3, provides a rigid elongation stopper or mechanical stopper ("positive stop") 9A and 9B to prevent the tension resistant spring 5 from moving beyond a certain point. Advantageously, this prevents the bottom beam 3 from rising when high winds or other external forces cause a heavy loading on the door curtain 2. The positive stop 9 can comprise, as one example, a first member 9A which, when the spring stretches, engages a second member 9B affixed to the pulley 12. The mechanical stop mechanisms 9 described herein resists not only wind but also high loads caused by air-conditioning, fans and the like, or vertical forces applied to the door blade 2 by an intruder, for example. In addition, means can be provided for fixing the bottom beam 3 in a closed position, for example, by using mechanical or electromechanical locks.

Restricting the elongation of the tension resistant spring 5 provides tension between the bottom beam 3 and the top roll 1. This, in turn, prevents external loading of wind or other forces from raising the bottom beam 3, since movement thereof is restricted via the cabling 6, as long as the top roll 1 does not move. The movement of top roll 1 can be prevented by a motor brake, or in extreme conditions, by adding a supplemental locking device. Incidentally, it is noted that cable 6 elongation under loading can reduce the effectiveness of the device, and that, therefore, care should be taken in selecting the cable 6 so to minimize unwanted elongation. Further, one of skill in the art will appreciate that the springs 5 and 13 could in fact be a combination of two or more springs which could be positioned in a variety of positions including attached to either to top or bottom of the doorway or inside of the top roll, can further be located on one or both sides of the door, and can be connected in parallel or serial arrangement. Further, those of skill in the art will understand that the springs 5 and 13 can be made of rubber ropes that are connected in parallel or formed in loops. Similarly, a pneumatic or gas spring, or hydraulic spring can be substituted for the springs 5 and 13 in each of the embodiments of the present invention.

Those of skill in the art will understand that the door blade 2 can comprise coated fabrics, polymeric film, flexible or rigid slats or lamellae, or any other materials that can be rolled up. In addition, the door blade can be flexible in all directions, or flexible only in the rolling direction while being made substantially inflexible in other directions via stiffing members fastened to the door blade 2, or via other suitable means. Additionally, instead of being vertical, the door can be horizontal so to operate sideways, or can even be installed on an angle. Note also that the bottom beam 3 need not be included, in which case the cable(s) 6 can be fixed to the bottom corners of the door blade 2.

As described above, the present invention provides certain advantages over prior proposals for preventing the raising of the door in high wind conditions or when other forces act on the door curtain 2. For example, one prior art door system provides high amounts of tension from the tension/balance system at open positions, but this is considered undesirable since this introduces instability to mechanical door systems. It is further noted that locking systems have been employed, but are disadvantaged by additional costs and complexity. The advantages provided by the door system according to the present invention, on the other hand, include high reliability, low cost, and, in particular, the flexibility to provide crash functions.

It is noted that prior art attempts at designing an anti-crash function for a door with a high pulldown tensioning system have proved problematic. For example, one prior art door design, a so-called "Posidrive" system, limits the inclusion of a anti-crash function, due to a requirement that the bottom beam 3 be rigidly connected to the drive system.

The design of the present invention, on the other hand, provides the higher pulldown tension only at the closed position of the door. This means that at intermediate positions of door movement, the bottom beam 3 is less tensely connected to the drive system. (Note, however, that the biasing means always provides some tensioning of the curtain 2). Accordingly, the use of an anti-crash system in conjunction with the present invention is simplified by this more flexible coupling of the bottom beam 3 to the drive system.

One example of an anti-crash device releases the door curtain from the guide channels, in which the door curtain is raised and lowered, upon application of a high external force, such as when hit by a vehicle or other moving object. Anti-crash devices do not release the door when subjected to high wind conditions or by forces applied by burglar attacks, for example. It is noted that the anti-crash systems typically operate best when the door is in the "almost open" position (where most collisions occur), and are generally less effective as the door reaches the closed position. Anti-crash devices may include a variety of mechanical or electromechanical designs, including but not limited to a pin that is broken at some threshold pressure, a sensor connected to a release device, or a spring-loaded arrangement. An anti-crash device is optionally included in each of the embodiments described herein.

Figure 6:
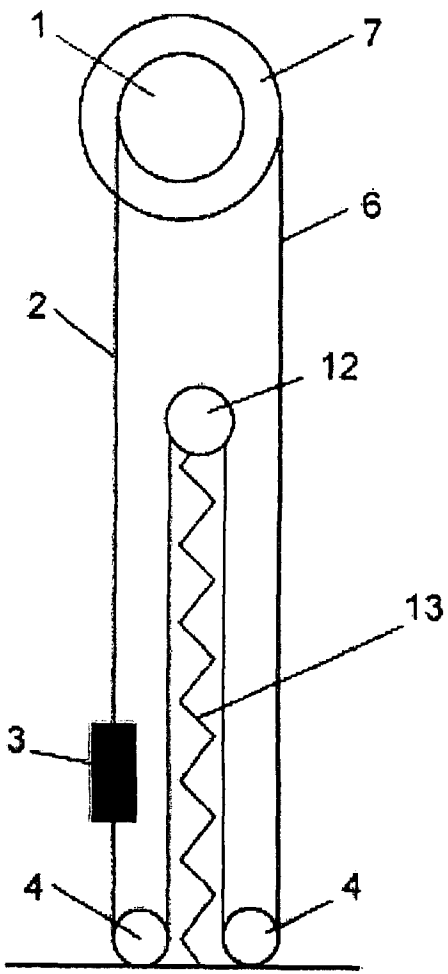
FIG. 6 is a side view of a door system with a spring stop in an alternate position according to the present invention.
Figure 5:
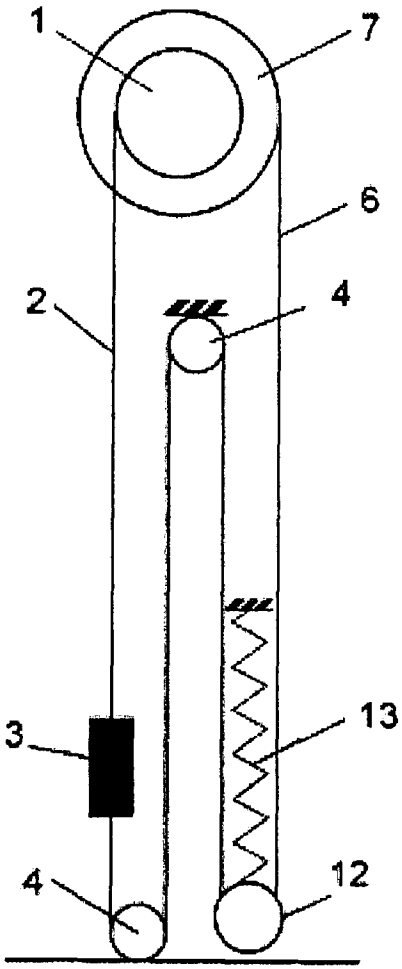
FIG. 5 is a side view of a door system with a spring stop according to the present invention.
Figure 4:
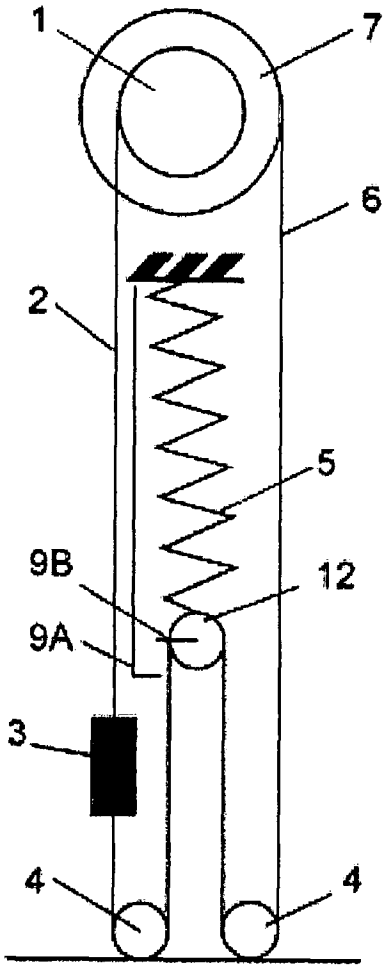
FIG. 4 is a side view of a door system with a mechanical stop and an alternate spring position according to the present invention.

FIGS. 4–6 illustrate further variations of the present invention. For example, FIG. 4 shows an embodiment wherein the spring tension resistant 5 and stopper 9 are positioned near the top of the doorway instead of at the bottom. FIGS. 5 and 6 show further variations wherein a compression resistant spring 13 is provided instead of a tension resistant spring, as shown in FIG. 1. The compression resistant spring 13 can be positioned either extending downward as shown in FIG. 5, or extending upward as shown in FIG. 6. In either case, the compression resistant spring 13 itself functions as the positive stop when the spring 13 is fully compressed. Note that with each of the embodiments shown in FIGS. 4–6, restricting elongation or compression of the of the spring 5 or 13 advantageously prevents the bottom beam 3 from rising when external forces act on the door curtain 2. The compression spring elements shown in these drawings could also represent a spring element consisting of compression springs in series or parallel arrangements.

Figure 9:
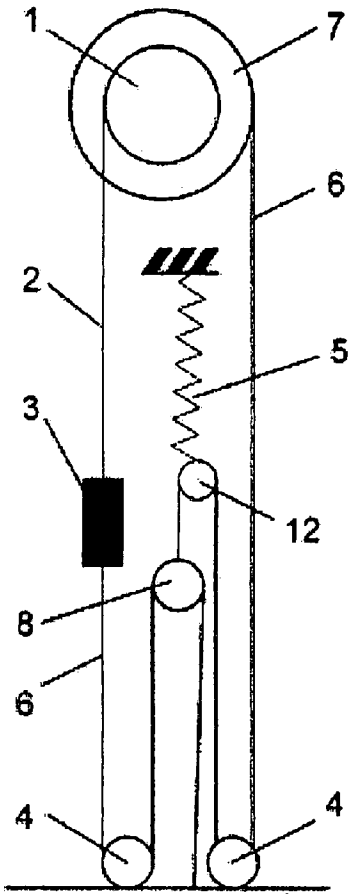
FIG. 9 is a side view of a door system with a reduction pulley and an alternative spring position according to the present invention.
Figure 7:
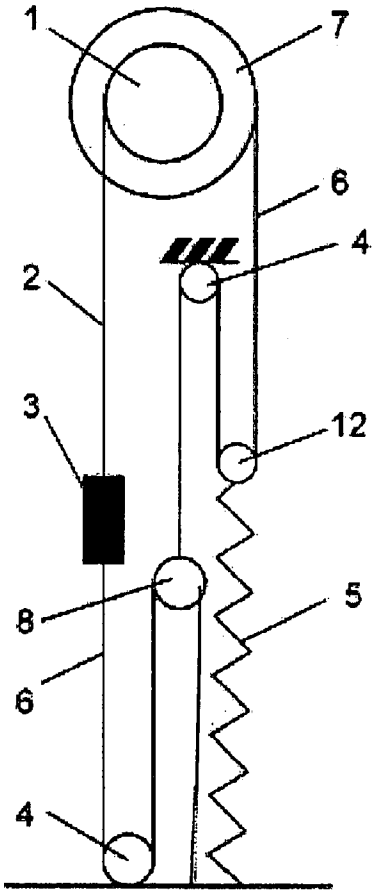
FIG. 7 is a side view of a door system with a reduction pulley according to the present invention.

FIGS. 7–12 show further variations of the invention wherein an extra pulley 8 ("reduction pulley") and a divided cable 6 are provided. This arrangement achieves the advantage of a reduced pull down force and allows for a reduced cable drum diameter, which provides both economic and space consideration savings. For example, the embodiment shown in FIG. 7 provides a door curtain 2 having a bottom beam 3 and which winds about a top roll 1. A first cable portion 6 has one end connected to the cable drum 7 and runs over the pulley 12 loaded by the tension resistant spring 5, then over a stationary pulley 4, and the other cable end is connected to the reduction pulley 8. A second cable portion 6 has one end attached to the bottom beam 3, and runs therefrom over stationary pulley 4 and over the reduction pulley 8, and the other cable end is fixed near the bottom of the doorway. The tension resistant spring 5 can be alternatively positioned at the top of the doorway as shown in FIG. 9.

Figure 8:
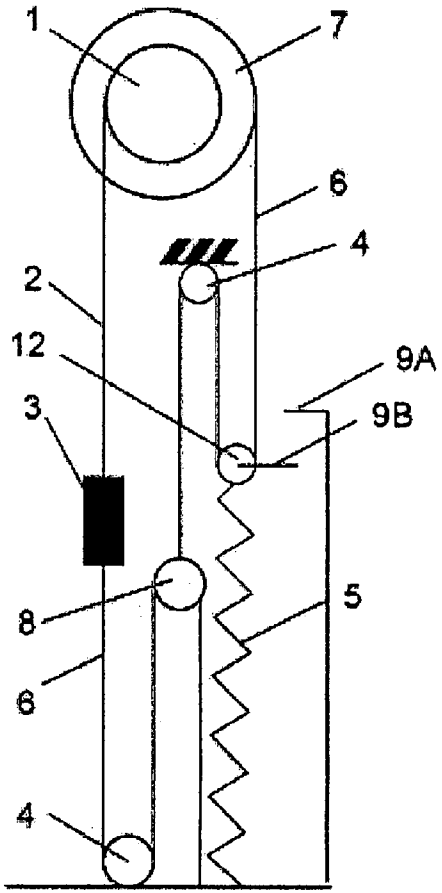
FIG. 8 is a side view of a door system with a reduction pulley and a mechanical stop according to the present invention.
Figure 12:
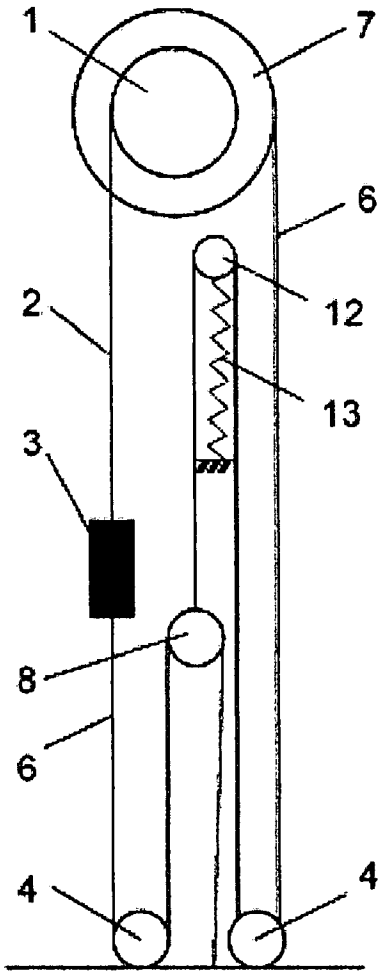
FIG. 12 is a side view of a door system with a reduction pulley and a spring stop in an alternate position according to the present invention.
Figure 11:
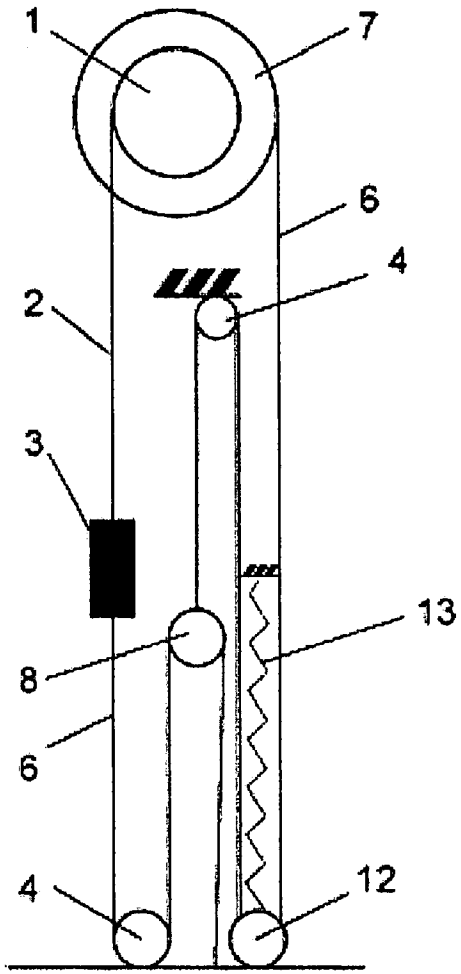
FIG. 11 is a side view of a door system with a reduction pulley and a spring stop according to the present invention.
Figure 10:
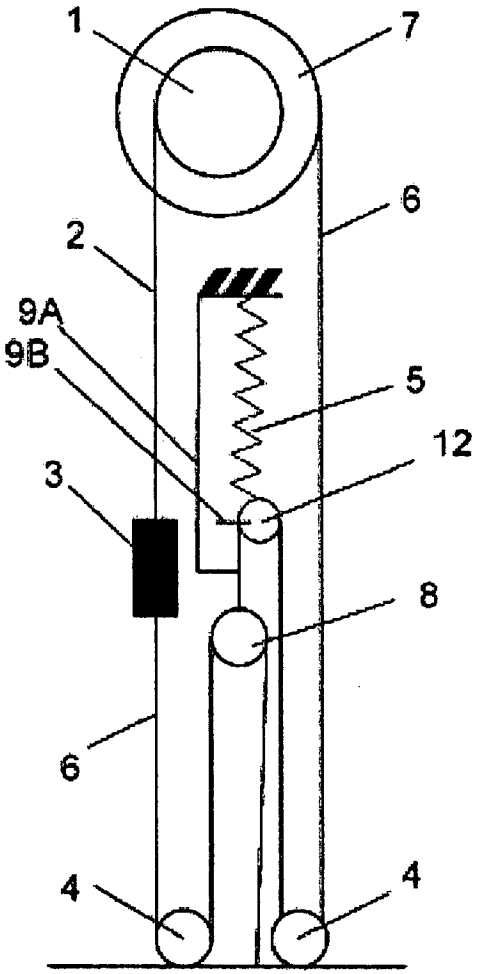
FIG. 10 is a side view of a door system with a reduction pulley, a mechanical stop, and an alternative spring position according to the present invention.
Figure 13:
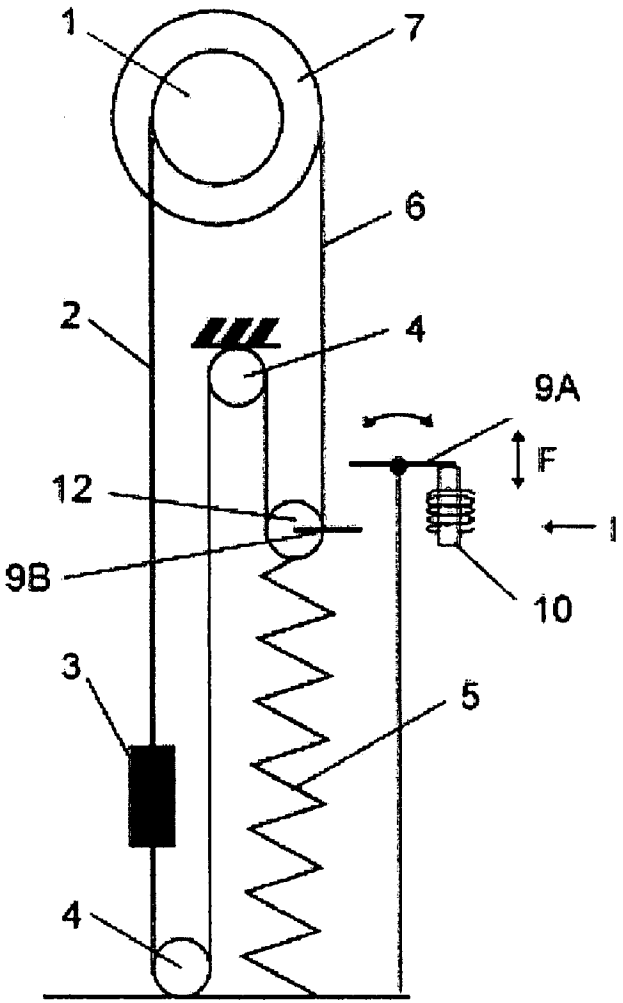
FIG. 13 is a side view of a door system with a pulley and an electro-mechanical positive stop according to the present invention.
Figure 17:
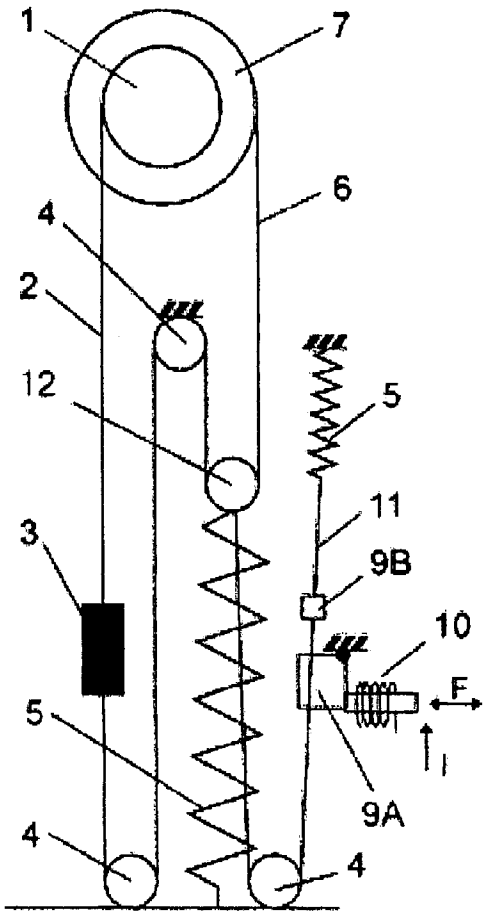
FIG. 17 is a side view of a door system with a pulley and an electro-mechanical stop according to the present invention.

In addition, an elongation stopper 9 can be further included as shown in FIGS. 8 and 10. Alternatively, a pressure spring 13 with the stop included in the spring 13 can be provided as shown in FIGS. 11 and 12. Thus, in addition to providing the advantage of reduced pull down force and cable drum diameter, the variations shown in FIGS. 8 and 10–12, wherein spring 5 or 13 elongation or compression is restricted, provide the further benefit of preventing curtain 2 movement during high load operation. The elongation stopper 9 can be equipped with a lock and release mechanism 10, for example an electromagnet, as shown in FIGS. 13, 17, and 20, which can be triggered by a sensor or by other suitable means. In each of the embodiments shown in FIGS. 2, 4, 8, and 10, restricting the elongation of the tension resistant spring 5 prevents the bottom beam 3 from rising when external forces act on the door curtain 2. In other embodiments referred to herein, similar lock and release mechanisms operate with similar effect. In addition, the examples provided herein are given by way of example and not intended to limit the scope of the present invention, as other lock and release mechanisms would be clearly recognized as operable herein by those of skill in the art.

Figure 14:
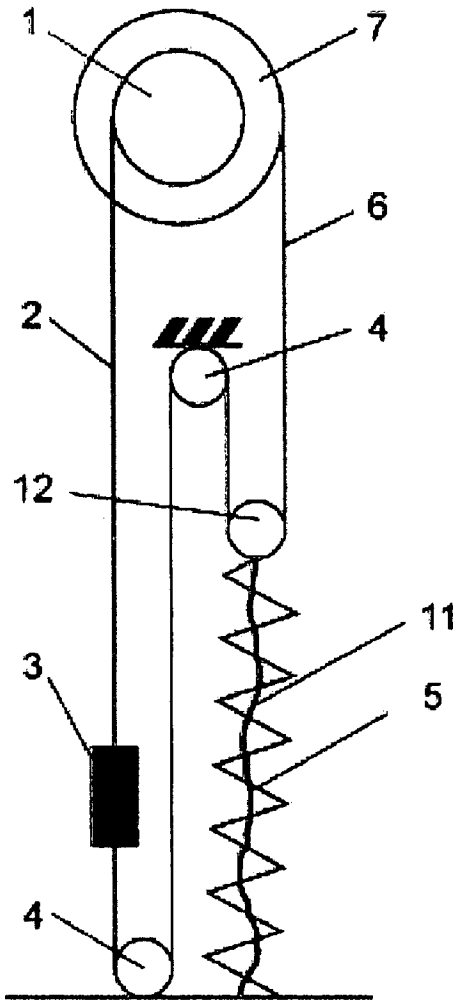
FIG. 14 is a side view of a door system with a pulley and a mechanical stop according to the present invention.

It will be appreciated by those of skill in the art that a variety of combinations of the springs or biasing means in combination with anti-crash or other safety means can be incorporated into the designs of the present invention. For example FIG. 14 depicts a high load operation door similar to that shown in FIG. 2, where the elongation stopper is replaced by a length of chain, rope, wire or the like 11 which limits the travel of the tension spring 5. As a safety feature, the chain 11 can be used in combination with a "weak link" mechanism (not shown) to protect the components of the door in the event of a crash, or other high load incidents.

Figure 2:
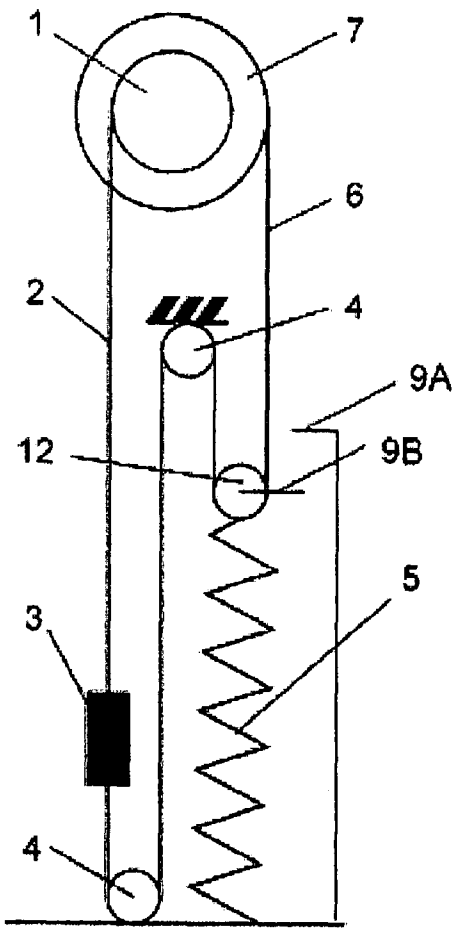
FIG. 2 is a side elevation view of a door system with a positive stop according to the present invention.
Figure 15:
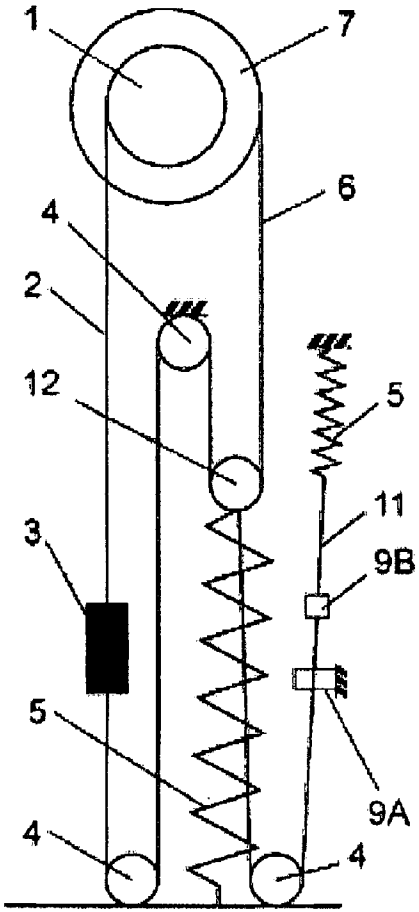
FIG. 15 is a side view of a door system with a pulley and a mechanical stop according to the present invention.

FIG. 15 shows a further variation of the high load door depicted in FIG. 2 further comprising a second tension resisting spring 5, and a mechanical elongation stopper 9A & 9B. The two springs are in series and both resist the movement of door, while the mechanical stopper 9A and 9B prevents the movement of the springs 5 and ultimately the door 2 beyond a predetermined point.

Figure 16:
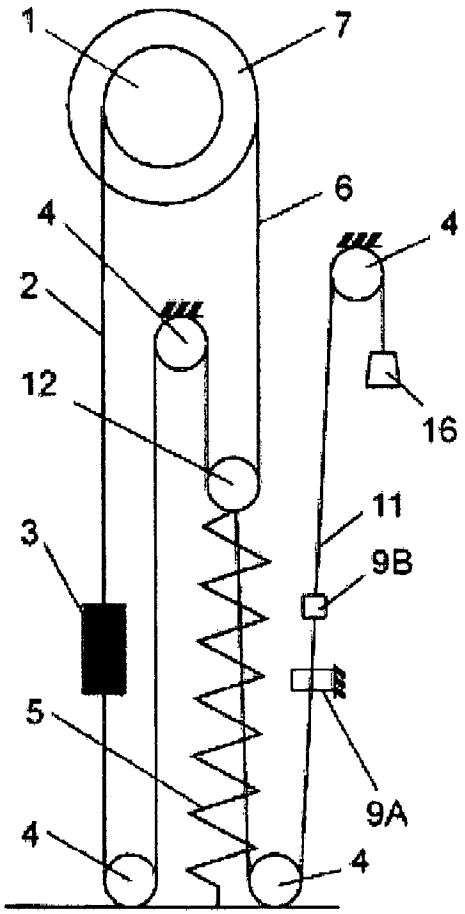
FIG. 16 is a side view of a door system with a pulley and a weighted mechanical stop according to the present invention.

FIG. 16 shows a high load door which is nearly identical to that shown in FIG. 15, the main difference being that a weight 16 is substituted for the second spring 5. The weight 16 works in concert with the spring 5 to prevent the door 2 from rising. Naturally, the mass of the weight can be optimized, by those of skill in the art, for a specific application.

FIG. 17 depicts another embodiment of the high load door according to the present invention. The embodiment shown in FIG. 17 combines the electro-mechanical lock and release mechanism 10 shown in the embodiment of FIG. 13 used in combination with the double spring 5 and mechanical stopper 9A and 9B shown in FIG. 15. In this embodiment, the movement of the two springs 5 is limited by the mechanical stopper 9A and 9B until the occurrence of an event which releases the electromechanical lock mechanism 10, thereby releasing portion 9A of the mechanical stopper and allowing the force applied to the door 2 to act on the springs 5.

FIG. 18 shows yet another embodiment of the present invention using a compression resistant spring 13 and a tension resistant spring 5. The compression resistant spring 13 works in conjunction with a mechanical stopper 9A and 9B to limit the travel of the door 2. While the compression resistant spring 13 and the tension resistant spring 5 work to slow or prevent the movement of the door 2 within the travel limit. FIG. 19 depicts a nearly identical system to that shown in FIG. 18 except that the compression resistant spring 13 is replaced with a pneumatic or gas spring 15. As shown in FIG. 19, the gas spring 15 can include one or more pressure valves 14 that can be used to assist in limiting the travel of the door 2. Similar functionality using valves could be obtained by substituting a hydraulic spring arrangement for the pneumatic spring.

A further embodiment of the present invention is shown in FIG. 20 comprising a compression resistant spring 13 used in combination with a mechanical stopper 9A and an electromechanical lock and release mechanism 10.

Thus by the foregoing examples, the objects and advantages of the present invention are realized, and although preferred embodiments have been disclosed and described in detail herein, its scope and objects should not be limited thereby; rather its scope should be determined by that of the appended claims.

What is claimed is:

1. A rolling door comprising:

a roll and a means for collecting a cable positioned near an aperture for the door and provided with a drive system;

a door curtain to be wound upon the roll and unwound from said roll;

a biasing means operable to travel or stretch when an external load is applied to the curtain;

the cable to be wound and unwound from said means for collecting said cable, and having a first end connected to a bottom of said curtain, the cable running therefrom over pulleys, and a second end of the cable being connected to the cable-collecting means; and means for preventing the biasing means from traveling beyond a predetermined point, so to prevent movement of the curtain when the load is applied to the curtain when in a closed position.

2. The rolling door of claim 1, wherein the biasing means is positioned on one side of the door or near one of a first end of the door or an opposite end thereof.

3. The rolling door of claim 1, wherein the biasing means are arranged on each side of the door and connected in one of parallel or serial arrangement.

4. The rolling door of claim 1, wherein the biasing means comprises one or more springs.

5. The rolling door of claim 4, wherein the springs can be selected from the group consisting of tension resistant springs, compression resistant springs, hydraulic springs, and pneumatic springs.

6. The rolling door of claim 5, wherein two or more springs are connected in series.

7. The rolling door of claim 5, wherein two or more springs are connected in parallel.

8. The rolling door of claim 1, wherein the biasing means comprises rubber rope or ropes connected in parallel or loops.

9. The rolling door of claim 1, wherein the biasing means is one or more gas springs.

10. The rolling door of claim 1, wherein the biasing means is a spring element, such that said spring element also acts as the means for preventing itself from traveling beyond a predetermined point when the spring element is either elongated or compressed maximally.

11. The rolling door of claim 1, wherein the biasing means is a counterweight.

12. The rolling door of claim 1, wherein said means for preventing said biasing means from traveling beyond said predetermined point is positioned at one of a first end of the door end or the opposite end thereof.

13. The rolling door of claim 1, wherein a rigid stop is provided as said means for preventing biasing means travel.

14. The rolling door of claim 1, wherein the load applied is one of a wind force, pressure differences caused by air-conditioning fans, a vertical force, or a horizontal force.

15. The rolling door of claim 1, further comprising means for preventing movement of the roll when the load is applied to the closed curtain in a closed position.

16. The rolling door of claim 15, wherein said means for preventing roll movement is a drive system brake.

17. The rolling door of claim 15, wherein said means for preventing roll movement is a locking mechanism.

18. The rolling door of claim 1, further comprising one of a mechanical or electromechanical lock for fixing the door curtain in the closed position.

19. The rolling door of claim 1, further comprising one or more of a door blade edge fixing device, wind bars, or stiff door blade reinforcements.

20. The rolling door of claim 1, wherein said cable experiences minimal elongation when under tension.

21. The rolling door of claim 1, wherein said door is provided with an anti-crash device.

22. The rolling door of claim 21, wherein said anti-crash device operates fully when the door is in a substantially open position.

23. The rolling door of claim 18, wherein a sensor is capable of releasing the lock to support an anti-crash device.

24. The rolling door of claim 21, wherein said door is provided with an anti-crash function that operates fully when the door curtain is in any of an open, closed or intermediate positions.

25. The rolling door of claim 1, wherein said rolling door is oriented in one of a vertical, horizontal, or angled directions.

26. The rolling door of claim 1, wherein the door curtain comprises one of coated fabric, polymeric film, or slats.

27. The rolling door of claim 1, wherein the door curtain is flexible only in a wound or unwound direction.

28. The rolling door of claim 1, wherein a bottom beam is attached to a bottom of the door curtain.

29. The rolling door of claim 1, wherein said means for collecting said cable is a cable drum.

30. A rolling door comprising:

a roll and a means for collecting a first cable positioned near an aperture for the door and provided with a drive system;

a door curtain to be wound upon the roll and unwound from said roll;

a biasing means operable to travel or stretch when an external load is applied to the curtain;

the first cable being wound and unwound from said cable-collecting means and having one end connected thereto, the first cable running therefrom over first and second pulleys, and the other end of the first cable being fixed to a reduction pulley; and a second cable with one end being fixed, the second cable running over the reduction pulley and a third pulley, and the other cable end being connected to the door curtain.

31. The rolling door of claim 30, further comprising means for preventing the biasing means from traveling beyond a predetermined point, so to prevent movement of the door curtain when the load is applied.

32. The rolling door of claim 30, wherein the biasing means is positioned on one side of the door or near one of a first end of the door or an opposite end thereof.

33. The rolling door of claim 30, wherein the biasing means are arranged on each side of the door and connected in one of parallel or serial arrangement.

34. The rolling door of claim 30, wherein the biasing means comprises one or more springs.

35. The rolling door of claim 34, wherein the springs can be selected from the group consisting of tension resistant springs, compression resistant springs, and pneumatic springs.

36. The rolling door of claim 35, wherein two or more springs are connected in series.

37. The rolling door of claim 35, wherein two or more springs are connected in parallel.

38. The rolling door of claim 30, wherein the biasing means comprises rubber rope or ropes connected in parallel or loops.

39. The rolling door of claim 30, wherein the biasing means is one or more gas springs.

40. The rolling door of claim 30, wherein the biasing means is a spring element, such that said spring element also acts as the means for preventing itself from traveling beyond a predetermined point when the spring element is either elongated or compressed maximally.

41. The rolling door of claim 30, wherein the biasing means is a counterweight.

42. The rolling door of claim 30, wherein said means for preventing said biasing means from traveling beyond said predetermined point is positioned at one of a first end of the door end or the opposite end thereof.

43. The rolling door of claim 31, wherein a rigid stop is provided as said means for preventing biasing means travel.

44. The rolling door of claim 30, wherein the load applied is one of a wind force, pressure differences caused by air-conditioning fans, or a vertical force.

45. The rolling door of claim 30, further comprising means for preventing movement of the roll when the load is applied to the curtain in a closed position.

46. The rolling door of claim 45, wherein said means for preventing roll movement is a drive system brake.

47. The rolling door of claim 45, wherein said means for preventing roll movement is a locking mechanism.

48. The rolling door of claim 30, further comprising one of a mechanical or electromechanical lock for fixing the door curtain in the closed position.

49. The rolling door of claim 30, further comprising one or more of a door blade edge fixing device, wind bars, or stiff door blade reinforcements.

50. The rolling door of claim 30, wherein said cable experiences minimal elongation when under tension.

51. The rolling door of claim 30, wherein said door is provided with an anti-crash device.

52. The rolling door of claim 51, wherein said anti-crash device operates fully when the door is in a substantially open position.

53. The rolling door of claim 48, wherein a sensor is capable of releasing the lock.

54. The rolling door of claim 51, wherein said door is provided with an anti-crash function that operates fully when the door curtain is in any of an open, closed or intermediate positions.

55. The rolling door of claim 30, wherein said rolling door is oriented in one of a vertical, horizontal, or angled directions.

56. The rolling door of claim 30, wherein the door curtain comprises one of coated fabric, polymeric film, or slats.

57. The rolling door of claim 30, wherein the door curtain is flexible only in a wound or unwound direction.

58. The rolling door of claim 30, wherein a bottom beam is attached to the bottom of the door curtain.

59. The rolling door of claim 30, wherein said means for collecting said cable is a cable drum.

* * * * *